US009492940B2

(12) United States Patent
Yen

(10) Patent No.: US 9,492,940 B2
(45) Date of Patent: Nov. 15, 2016

(54) STATIONERY PUNCHING DEVICE FOR CREATING A DECORATIVE CRAFT

(71) Applicant: Chin-Wen Yen, Tainan (TW)

(72) Inventor: Chin-Wen Yen, Tainan (TW)

( * ) Notice: Subject to any disclaimer, the term of this patent is extended or adjusted under 35 U.S.C. 154(b) by 72 days.

(21) Appl. No.: 14/243,511

(22) Filed: Apr. 2, 2014

(65) Prior Publication Data

US 2015/0283723 A1 Oct. 8, 2015

(51) Int. Cl.

| | |
|---|---|
| ***B26D 7/06*** | (2006.01) |
| ***B26D 7/08*** | (2006.01) |
| ***B26F 1/14*** | (2006.01) |
| ***B26D 7/00*** | (2006.01) |
| ***B26D 5/10*** | (2006.01) |
| ***B26F 1/36*** | (2006.01) |
| *B26D 7/18* | (2006.01) |
| *B21D 28/34* | (2006.01) |
| *B21D 45/00* | (2006.01) |
| *B21F 1/02* | (2006.01) |
| *B26F 1/44* | (2006.01) |

(52) U.S. Cl.

CPC . *B26F 1/14* (2013.01); *B26D 5/10* (2013.01); *B26D 7/0006* (2013.01); *B26F 1/36* (2013.01); *B21D 28/34* (2013.01); *B21D 45/003* (2013.01); *B21F 1/02* (2013.01); *B26D 7/1818* (2013.01); *B26F 2001/4481* (2013.01); *Y10T 83/885* (2015.04)

(58) Field of Classification Search

CPC .... B26F 1/14; B26F 1/02; B26F 2001/4481; B26F 1/36; B26D 5/10; B26D 7/0006; B26D 7/1818; B21D 28/34; B21D 5/003; Y10T 83/885

USPC ..... 83/633, 582, 685, 684, 634, 635; 30/278

See application file for complete search history.

(56) References Cited

U.S. PATENT DOCUMENTS

| | | | | | |
|---|---|---|---|---|---|
| 2,962,178 | A * | 11/1960 | Exline | G07D 9/004 | 414/416.08 |
| 5,749,278 | A * | 5/1998 | Lee | B26F 1/36 | 83/588 |
| 6,089,137 | A * | 7/2000 | Lee | B26F 1/04 | 30/358 |
| 8,635,936 | B2 * | 1/2014 | Lee | B26D 7/1818 | 83/125 |
| 2007/0056422 | A1 * | 3/2007 | Lee | B26F 1/22 | 83/582 |
| 2008/0034937 | A1 * | 2/2008 | Aniceto | B26F 1/22 | 83/588 |
| 2008/0060567 | A1 * | 3/2008 | Aniceto | B26F 1/14 | 112/475.01 |
| 2009/0049971 | A1 * | 2/2009 | Yamashita | B26D 7/015 | 83/468 |
| 2010/0116115 | A1 * | 5/2010 | Exley | B26F 1/32 | 83/633 |
| 2013/0340586 | A1 * | 12/2013 | Yen | B26D 5/10 | 83/582 |
| 2014/0165811 | A1 * | 6/2014 | Lee | B26D 5/08 | 83/633 |

* cited by examiner

*Primary Examiner* — Omar Flores Sanchez

(74) *Attorney, Agent, or Firm* — Pillsbury Winthrop Shaw Pittman, LLP

(57) ABSTRACT

A stationery punching device for creating a decorative craft that includes a die support frame, a punch guiding frame aligned with the die support frame, a punch, a pivot seat connected to at least one of ends of the die support frame and the punch guiding frame, an operating lever pivoted to the pivot seat, and an urging member for urging the punch. The pivot seat is spaced apart from the punch guiding frame by first and second slits, so that when an upward pulling force acts on the pivot seat, the upward pulling force cannot be transmitted from the pivot seat directly to the two sides and one end of the punch guiding frame.

6 Claims, 9 Drawing Sheets

STATIONERY PUNCHING DEVICE FOR CREATING A DECORATIVE CRAFT

BACKGROUND OF THE INVENTION

1. Field of the Invention

This invention relates to a stationery punching device for creating a decorative craft, more particularly to a stationery punching device including a punch guiding frame and a pivot seat that is spaced apart from the punch guiding frame by a slit.

2. Description of the Related Art

FIGS. 1 and 2 illustrate a conventional stationery punching device for punching or embossing a sheet material (not shown) to create a desired decorative shape for a decorative project, such as scrapbooking or other crafts. The conventional stationery punching device includes a die support frame 111, a punch guiding frame 112, a connecting member 113 interconnecting one end of the die support 111 and a connecting end 1121 of the punch guiding frame 112, a punch 12 supported movably on the punch guiding frame 112, a pivot protrusion 116 extending upwardly from a pivot end 1122 of the punch guiding frame 112, a lever 14 pivoted to the pivot protrusion 116 for driving movement of the punch 12 along a vertical direction (X), and two urging members 13 for urging the punch 12 to move away from the die support frame 111. The punch guiding frame 112 is disposed above and cooperates with the die support frame 111 to define a sheet-receiving slot 114 therebetween for receiving a paper sheet to be punched. The die support frame 111, the punch guiding frame 112 and the connecting member 113 are formed into a single piece of a rigid material, such as plastics or metal.

The punch guiding frame 112 is formed with at least one punch guiding hole for passage of the punch 12 therethrough and for guiding movement of the punch 12 along the vertical direction (X). However, each time the lever 14 is pressed downward, an upward counter force (F) that acts on the pivot protrusion 116 is generated, which results in generation of a torque that pulls the pivot end 1122 of the punch guiding frame 112 upward to pivot about the connecting end 1121 of the punch guiding frame 112, which may cause deformation of the punch guiding frame 112, which, in turn, results in inclination of the punch 12 relative to the vertical direction. As such, the punch 12 may interfere with the die support frame 111 and cannot punch through the paper sheet (see FIG. 3), or the punch 12 may not precisely punch through the paper sheet, such that undesired rough edges on the punched paper sheet are formed and poor quality of the punched object(s) is resulted.

SUMMARY OF THE INVENTION

Therefore, an object of the present invention is to provide a stationery punching device that can overcome the aforesaid drawback associated with the prior art.

According to the present invention, there is provided a stationery punching device for punching a sheet material to form a decorative craft. The stationery punching device comprises: a die support frame having first and second ends that are opposite to each other in a first direction, and two opposite sides that are opposite to each other in a second direction which is transverse to the first direction; a die mounted in the die support frame and formed with a die hole; a punch guiding frame disposed above and aligned with the die support frame along a vertical direction that is transverse to the first and second directions, the punch guiding frame having first and second ends and first and second sides, the first and second ends of the punch guiding frame being opposite to each other in the first direction and being respectively disposed adjacent to the first and second ends of the die support frame, the first and second sides of the punch guiding frame being opposite to each other in the second direction, being respectively disposed adjacent to the two opposite sides of the die support frame, and extending between the first and second ends of the punch guiding frame, the punch guiding frame cooperating with the die support frame to define a sheet-receiving slot therebetween for receiving the sheet material, the first ends of the die support frame and the punch guiding frame being connected securely to each other; a punch disposed movably on the punch guiding frame so as to be movable in the vertical direction relative to the die support frame and the punch guiding frame into the die hole; a pivot seat having a seat-pivot end that is disposed adjacent to the second end of the punch guiding frame, a connecting end that is opposite to the seat-pivot end in the first direction and that is disposed at and that is securely connected to at least one of the first ends of the die support frame and the punch guiding frame, and two side arms that are opposite to each other in the second direction and that are disposed adjacent to the first and second sides of the punch guiding frame, respectively; an operating lever having a lever-pivot end that is pivoted to the seat-pivot end of the pivot seat, and an operating end that is opposite to the lever-pivot end, the operating lever abutting against the punch and being rotatable relative to the die support frame for driving movement of the punch in the vertical direction; and an urging unit for urging the punch. The side arms of the pivot seat are spaced apart from the first and second sides of the punch guiding frame by first and second slits, respectively, and the pivot seat is spaced apart from the second end of the punch guiding frame so that when an upward pulling force acts on the seat-pivot end of the pivot seat, the upward pulling force cannot be transmitted from the side arms of the pivot seat to the first and second sides of the punch guiding frame and from the seat-pivot end of the pivot seat to the second end of the punch guiding frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
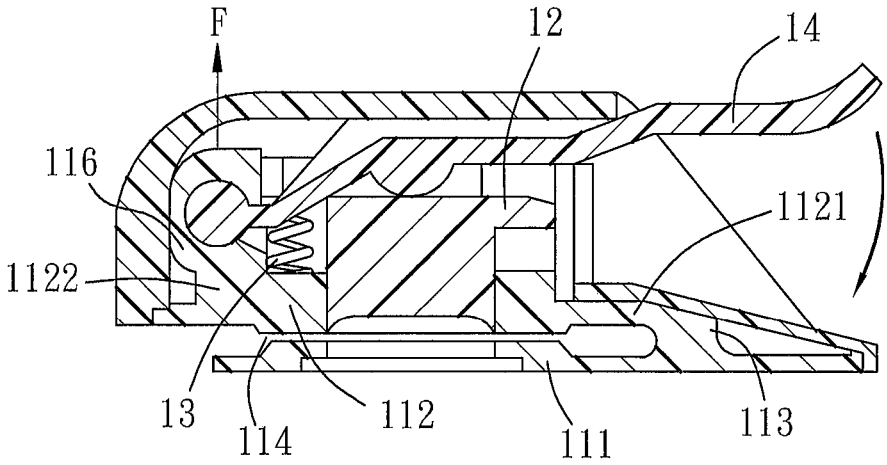
F I G. 1 PRIOR ART
FIG. 1 is a sectional view of a conventional stationery punching device.
Figure 2:
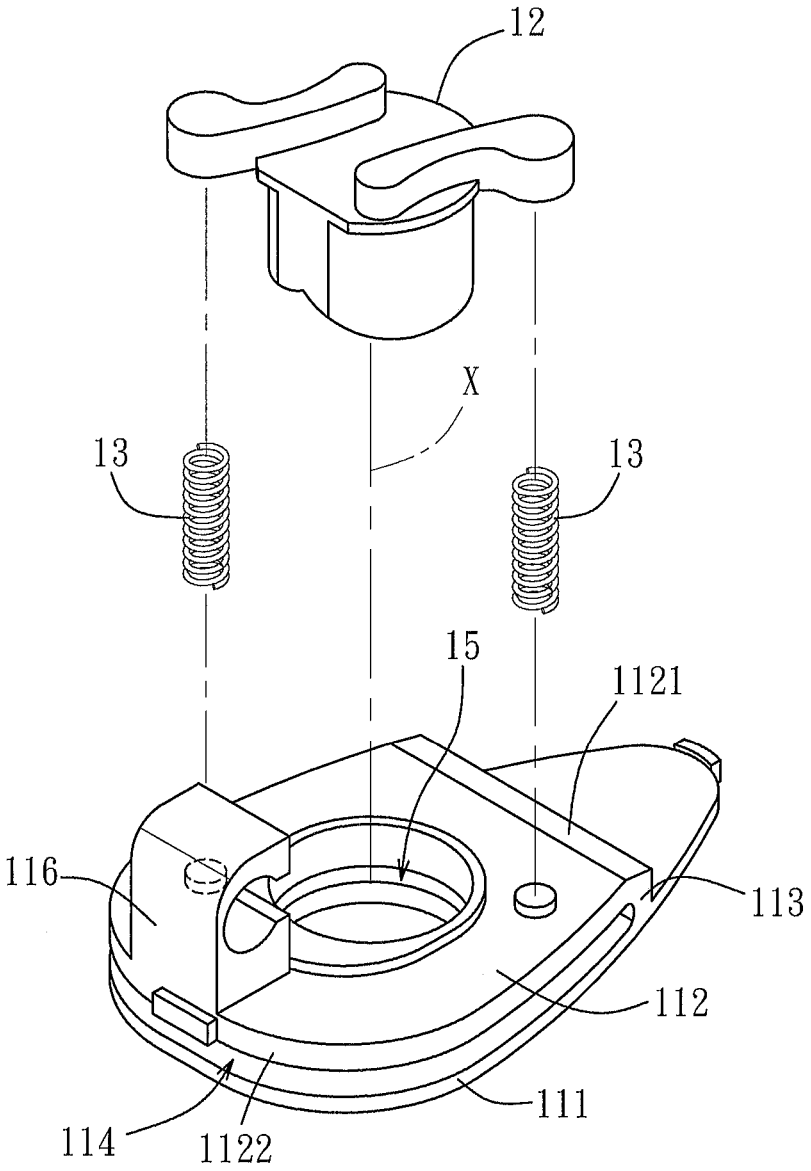
F I G. 2 PRIOR ART
FIG. 2 is an exploded perspective view of a portion of the conventional stationery punching device.
Figure 3:
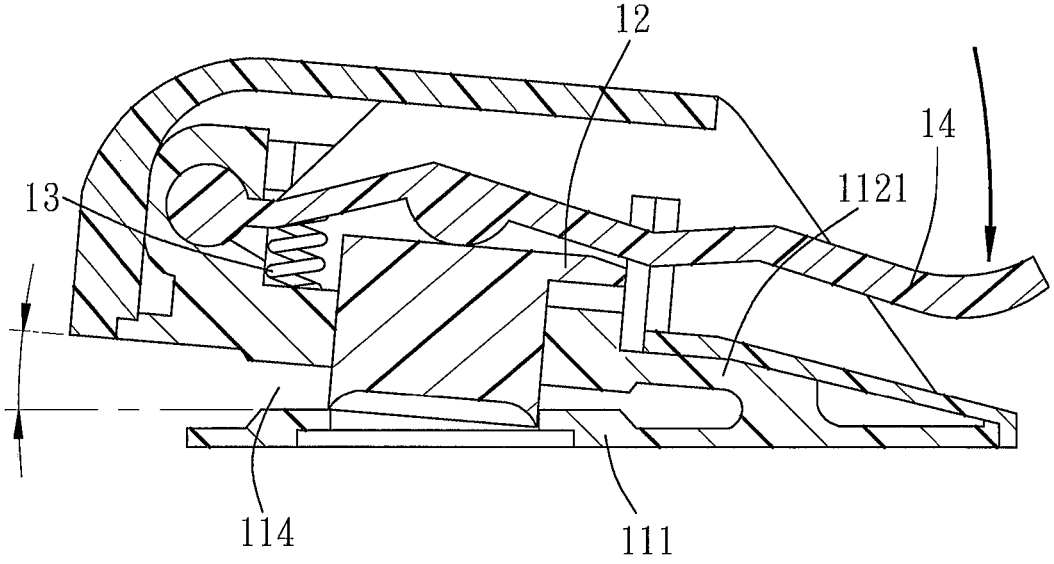
F I G. 3 PRIOR ART
FIG. 3 is a sectional view to illustrate a state where a punch guiding frame of the conventional stationery punching device is undesirably deformed during a punching operation.
Figure 4:
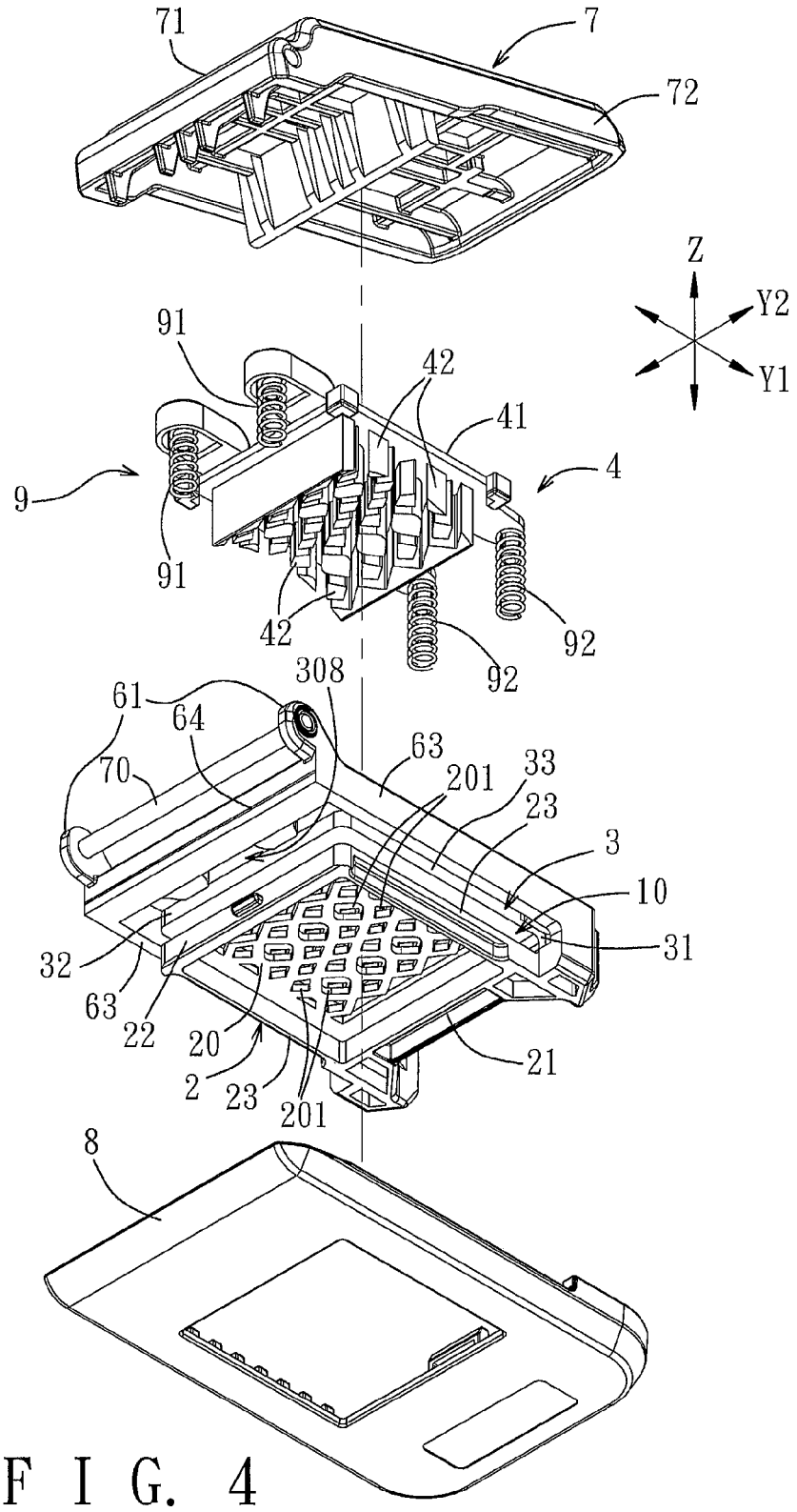
FIG. 4 is an exploded perspective bottom view of the preferred embodiment of a stationery punching device according to the present invention.
Figure 5:
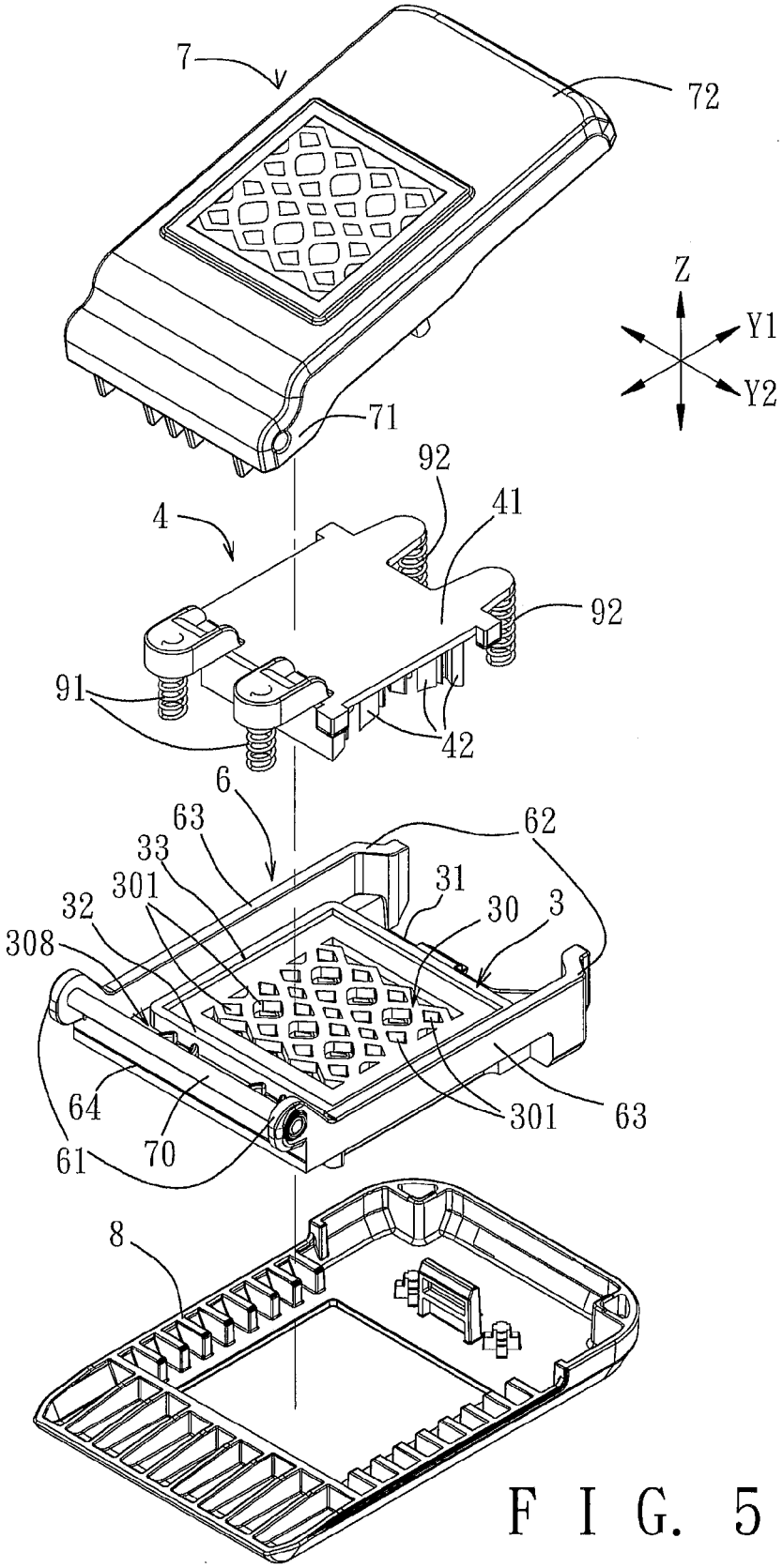
FIG. 5 is an exploded perspective top view of the preferred embodiment.

FIGS. 4 to 9 illustrate the preferred embodiment of a stationery punching device for punching a sheet material to form a decorative craft (not shown) according to the present invention.

The stationery punching device includes a base 8, a die support frame 2, a die 20, a punch guiding frame 3, a punch guide 30, a punch 4, a connecting member 5, a pivot seat 6, an operating lever 7 and an urging unit 9.

The die support frame 2 is mounted to the base 8, and has first and second ends 21, 22 that are opposite to each other in a first direction (Y1), and two opposite sides 23 that are opposite to each other in a second direction (Y2) which is transverse to the first direction (Y1). The die 20 is mounted in the die support frame 2, and is formed with a plurality of die holes 201. In this embodiment, the die 20 and the die support frame 2 are integrally formed as a single piece.

The punch guiding frame 3 is disposed above and is aligned with the die support frame 2 along a vertical direction (Z) that is transverse to the first and second directions (Y1, Y2). The punch guiding frame 3 has first and second ends 31, 32 and first and second sides 33. The first and second ends 31, 32 of the punch guiding frame 3 are opposite to each other in the first direction (Y1), and are respectively disposed adjacent to the first and second ends 21, 22 of the die support frame 2. The first and second sides 33 of the punch guiding frame 3 are opposite to each other in the second direction (Y2), are respectively disposed adjacent to the two opposite sides 23 of the die support frame 2, and extend between the first and second ends 31, 32 of the punch guiding frame 3. The punch guiding frame 3 cooperates with the die support frame 2 to define a sheet-receiving slot 10 therebetween for receiving the sheet material.

The connecting member 5 is disposed between and interconnects the first ends 21, 31 of the die support frame 2 and the punch guiding frame 3, and connects securely the first end 21 of the die support frame 2 to the first end 31 of the punch guiding frame 3. The connecting member 5 confines an end of the sheet-receiving slot 10. In this embodiment, the connecting member 5 and the first ends 21, 31 of the die support frame 2 and the punch guiding frame 3 are integrally formed as a single piece. Alternatively, the connecting member 5 may be in the form of a fastening mechanism that fastens the first ends 21, 31 of the die support frame 2 and the punch guiding frame 3.

The punch guide 30 is mounted in the punch guiding frame 3, and is formed with a plurality of guiding holes 301 for guiding movement of the punch 4 along the vertical direction (Z). In this embodiment, the punch guide 30 and the punch guiding frame 3 are integrally formed as a single piece.

The punch 4 includes a punch head 41 and a plurality of blades 42 extending from the punch head 41, and is disposed movably on the punch guiding frame 3 so as to be movable between an original position (see FIG. 8) and a punched position (see FIG. 9) in the vertical direction (Z) relative to the die support frame 2 and the punch guiding frame 3.

The pivot seat 6 has a seat-pivot end 61 that is disposed adjacent to the second end 32 of the punch guiding frame 3, a connecting end 62 that is opposite to the seat-pivot end 61 in the first direction (Y1) and that is disposed at and that is securely connected to at least one of the first ends 21, 31 of the die support frame 2 and the punch guiding frame 3, and two side arms 63 that are opposite to each other in the second direction (Y2), that extend from the connecting end 62 to the seat-pivot end 61, and that are disposed adjacent to the first and second sides 33 of the punch guiding frame 3, respectively. In this embodiment, the connecting end 62 of the pivot seat 6 is integrally formed with the first end 21 of the die support frame 2.

The operating lever 7 has a lever-pivot end 71 that is pivoted to the seat-pivot end 61 of the pivot seat 6 through a pivot shaft 70, and an operating end 72 that is opposite to the lever-pivot end 71. The operating lever 7 abuts against the punch head 41 of the punch 4, and is rotatable relative to the die support frame 2 for driving movement of the punch 4 in the vertical direction (Z).

Figure 6:
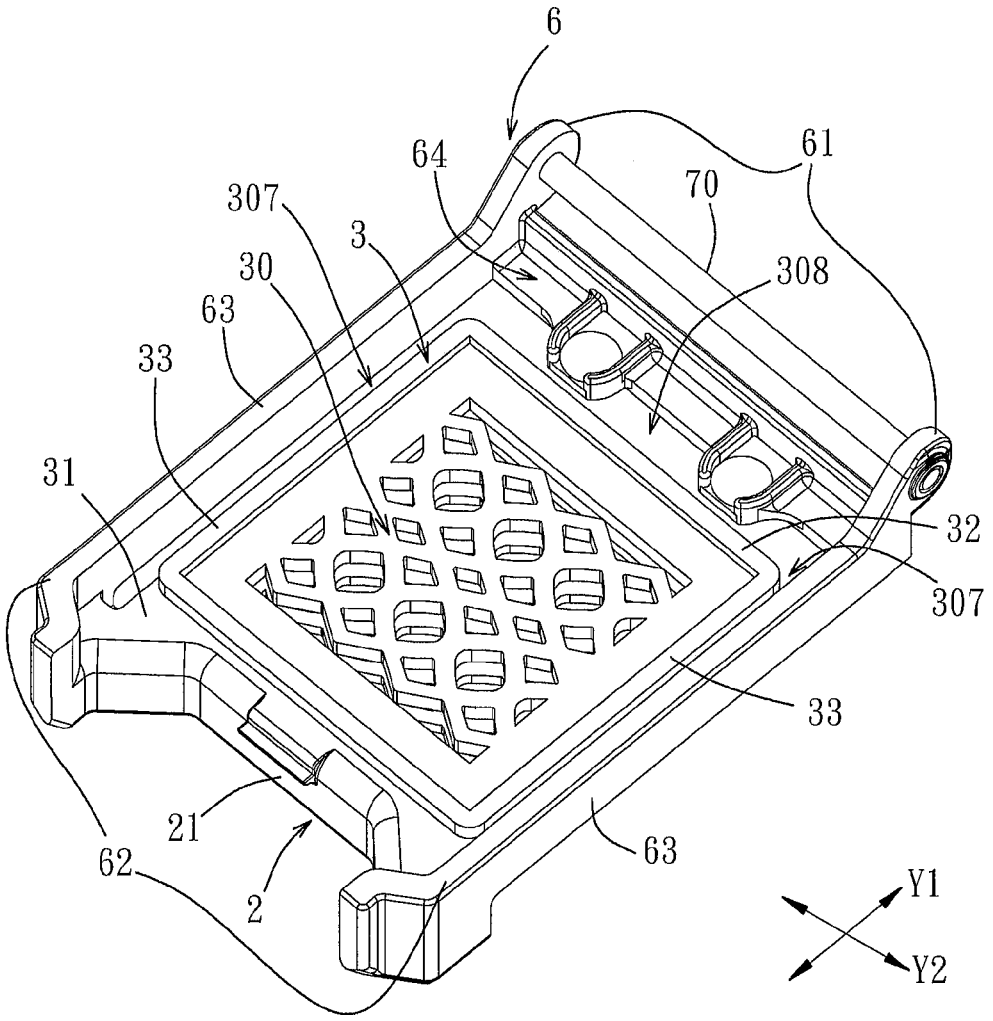
FIG. 6 is a perspective view of an assembly of a punch guiding frame, a die support frame and a pivot seat of the preferred embodiment.
Figure 7:
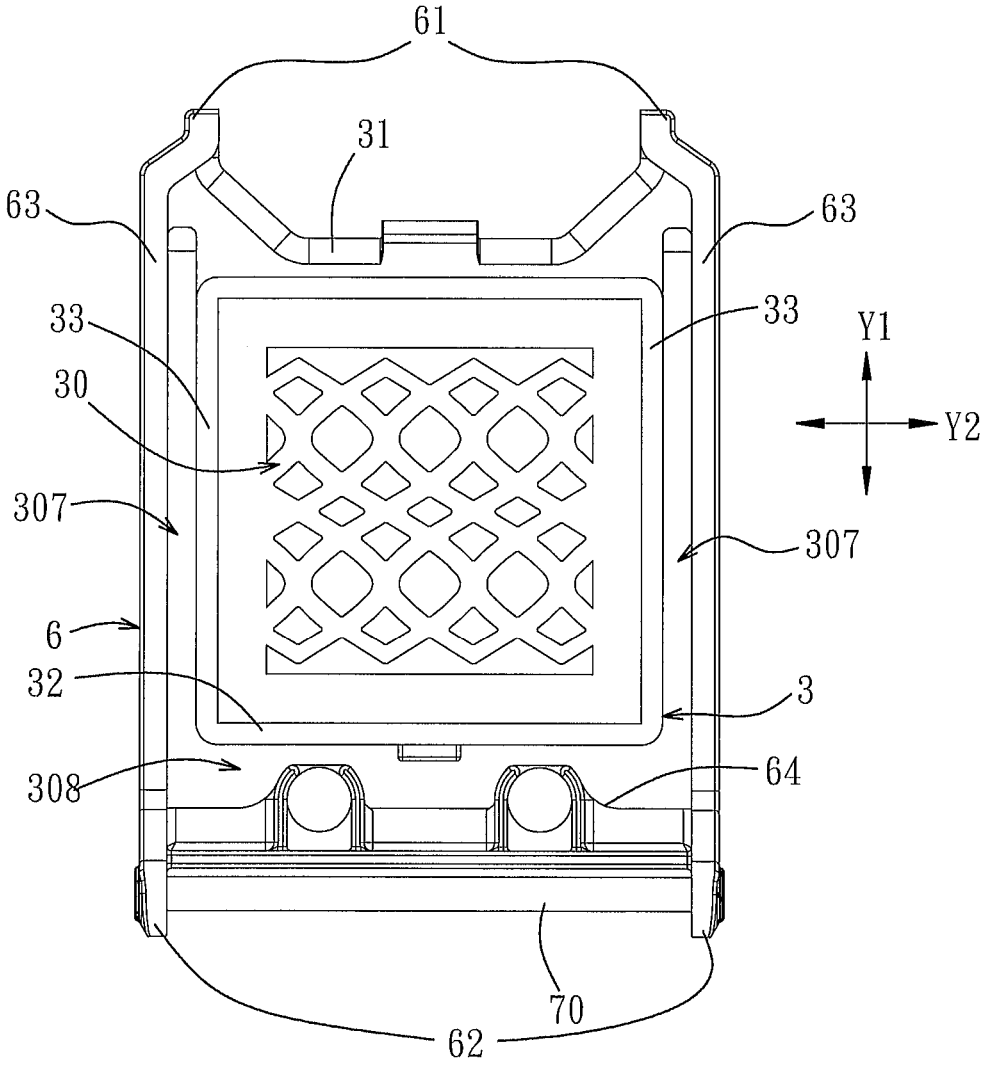
FIG. 7 is a top view of the assembly of the punch guiding frame, the die support frame and the pivot seat of the preferred embodiment.
Figure 8:
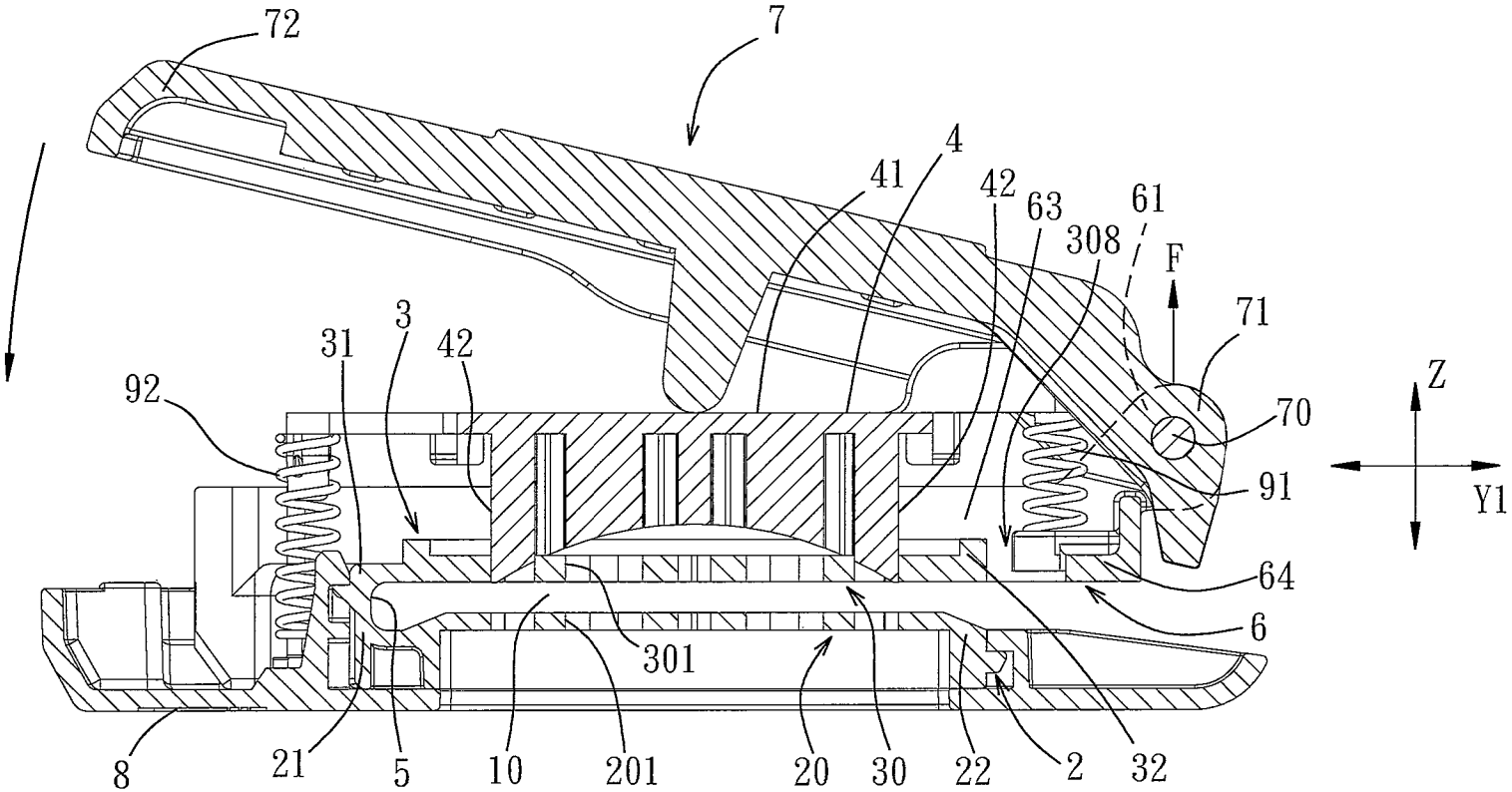
FIG. 8 is a sectional view illustrating a state where a punch of the preferred embodiment is disposed at an original position.
Figure 9:
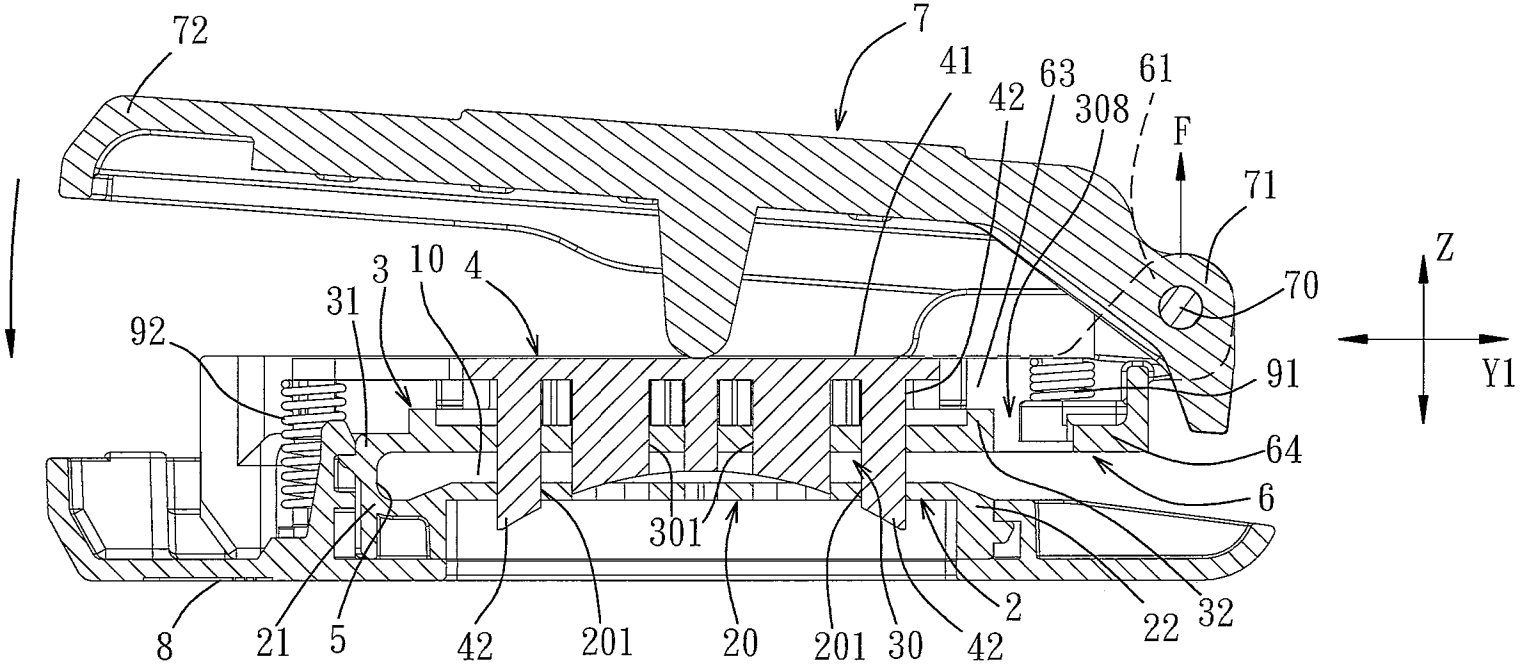
FIG. 9 is a sectional view illustrating another state where the punch of the preferred embodiment is disposed at a punched position.

The side arms 63 of the pivot seat 6 are spaced respectively apart from the first and second sides 33 of the punch guiding frame 3 in the second direction (Y2) by first and second slits 307, respectively (i.e., the first and second slits 307 are aligned with each other in the second direction (Y2), see FIGS. 6 and 7), and the pivot seat 6 is spaced apart from the second end 32 of the punch guiding frame 3, so that when an upward pulling force (F) acts on the seat-pivot end 61 of the pivot seat 6 (see FIGS. 8 and 9), the upward pulling force (F) cannot be transmitted from the side arms 63 of the pivot seat 6 directly to the first and second sides 33 of the punch guiding frame 3 and from the seat-pivot end 61 of the pivot seat 6 directly to the second end 32 of the punch guiding frame 3. As such, the punch guiding frame 3 can remain still and stay in the same position without being pulled by the upward pulling force (F) to have its second end 32 being slightly bent upward relative to the first end 31 of the punch guiding frame 3, thereby preventing occurrence of inclination of the punch 4 relative to the vertical direction (Z) or to the die support frame 2 during punching. As such, the interference between the punch and the die support frame and undesired rough edges formed on the punched objects as encountered in the prior art can be eliminated.

In this embodiment, the pivot seat 6 further has a crossbar 64 that is disposed adjacent to the second end 32 of the punch guiding frame 3, that interconnects the side arms 63, and that is spaced apart from the second end 32 of the punch guiding frame 3 in the first direction (Y1) by a third slit 308. The first, second and third slits 307, 308 are connected to one another in series to form a U-shaped cutout that surrounds the first and second sides 33 and the second end 32 of the punch guiding frame 3. It is noted that the crossbar 64 is optional and may be dispensed with.

The urging unit 9 urges the punch 4 to move back to the original position, and includes a pair of first springs 91 and a pair of second springs 92. The first springs 91 abut against the punch 4 and the crossbar 64, which is advantageous in that the force acted on the first springs 91 during punching is only transmitted to the crossbar 64 without being transmitted to the punch guiding frame 3 as encountered in the prior art, thereby preventing the punch guiding frame 3 from being deformed or inclined by the force.

The second springs 92 abut against the punch 4 and the base 8.

By forming the first and second slits 307 respectively between one of the side arms 63 of the pivot seat 6 and the first side 33 of the punch guiding frame 3 and between the other of the first side arms 63 of the pivot seat 6 and the second side 33 of the punch guiding frame 3 of the stationery punching device of this invention, the aforesaid drawback associated with the prior art can be eliminated.

While the present invention has been described in connection with that is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A stationery punching device for punching a sheet material to form a decorative craft, comprising:

a die support frame having first and second ends that are opposite to each other in a first direction, and two opposite sides that are opposite to each other in a second direction which is transverse to the first direction;

a die mounted in said die support frame and formed with a die hole;

a punch guiding frame disposed above and aligned with said die support frame along a vertical direction that is transverse to the first and second directions, said punch guiding frame having first and second ends and first and second sides, said first and second ends of said punch guiding frame being opposite to each other in the first direction and being respectively disposed adjacent to said first and second ends of said die support frame, said first and second sides of said punch guiding frame being opposite to each other in the second direction, being respectively disposed adjacent to said two opposite sides of said die support frame, and extending between said first and second ends of said punch guiding frame, said punch guiding frame cooperating with said die support frame to define a sheet-receiving slot therebetween for receiving the sheet material, said first ends of said die support frame and said punch guiding frame being securely connected to each other;

a punch disposed movably on said punch guiding frame so as to be movable in the vertical direction relative to said die support frame and said punch guiding frame into said die hole;

a pivot seat having a seat-pivot end that is disposed adjacent to said second end of said punch guiding frame, a connecting end that is opposite to said seat-pivot end in the first direction and that is disposed at and that is securely connected to at least one of said first ends of said die support frame and said punch guiding frame, and two side arms that are opposite to each other in the second direction and that are disposed adjacent to said first and second sides of said punch guiding frame, respectively;

an operating lever having a lever-pivot end that is pivoted to said seat-pivot end of said pivot seat, and an operating end that is opposite to said lever-pivot end, said operating lever abutting against said punch and being rotatable relative to said die support frame for driving movement of said punch in the vertical direction;

an urging unit for urging said punch; and first and second slits configured to respectively form a space between the side arms of said pivot seat and the sides of said punch guiding frame, said pivot seat being spaced apart from said second end of said punch guiding frame;

wherein, when an upward pulling force acts on said seat-pivot end of said pivot seat, the upward pulling force cannot be transmitted from said side arms of said pivot seat to said first and second sides of said punch guiding frame due to the first and second slits and from said seat-pivot end of said pivot seat to said second end of said punch guiding frame due to said pivot seat being spaced apart from said second end of said punch guiding frame.

2. The stationery punching device of claim 1, wherein said pivot seat further has a crossbar that is disposed adjacent to said second end of said punch guiding frame, that interconnects said side arms, and that is spaced apart from said second end of said punch guiding frame in the first direction by a third slit, said urging unit including at least one spring that abuts against said punch and said crossbar.

3. The stationery punching device of claim 1, wherein said first and second slits are aligned with each other in the second direction.

4. The stationery punching device of claim 3, wherein said pivot seat further has a crossbar that is disposed adjacent to said second end of said punch guiding frame, that interconnects said side arms, and that is spaced apart from said second end of said punch guiding frame in the first direction by a third slit, said first, second and third slits being connected to one another in series to form a U-shaped cutout that surrounds said first and second sides and said second end of said punch guiding frame.

5. The stationery punching device of claim 1, further comprising a punch guide that is mounted in said punch guiding frame and that is formed with a guiding hole for guiding and receiving said punch therethrough.

6. The stationery punching device of claim 1, further comprising a connecting member that is disposed between and that interconnects said first ends of said die support frame and said punch guiding frame and that confines an end of said sheet-receiving slot.

* * * * *